United States Patent [19]

Bauer et al.

[11] 4,032,465

[45] June 28, 1977

[54] PRODUCTION OF DETERGENT COMPOSITIONS

[75] Inventors: Herbert Edward Bauer, Saddle Brook, N.J.; Bertus Goossens, Vlaardinger, Netherlands; Theodorus Joannes Kock, Heenvliet, Netherlands; Johannes Laurentius Cornelis Manders, Roosendaal, Netherlands

[73] Assignee: Lever Brothers Company, New York, N.Y.

[22] Filed: Jan. 27, 1976

[21] Appl. No.: 652,946

[30] Foreign Application Priority Data

Feb. 3, 1975 United Kingdom ..... 4547/75

[52] U.S. Cl. ..... 252/135; 252/89 R; 252/174; 252/132; 252/539; 252/540; 260/535 P; 252/DIG. 11

[51] Int. Cl.[2] ..... C11D 11/02; C11D 3/06

[58] Field of Search ..... 252/135, 89, 109, 539, 252/DIG. 11; 260/535 P, 429.9, 439 R, 439 CT

[56] References Cited

UNITED STATES PATENTS

| | | | |
|---|---|---|---|
| 3,620,979 | 11/1971 | Corliss et al. | 252/109 |
| 3,743,610 | 7/1973 | Weldes | 252/135 |
| 3,914,297 | 10/1975 | Lamberti et al. | 252/135 |

*Primary Examiner*—Mayer Weinblatt
*Attorney, Agent, or Firm*—Michael J. Kelly; James J. Farrell; Melvin H. Kurtz

[57] ABSTRACT

Detergent compositions are prepared containing a carboxymethyloxysuccinate salt detergency builder by spray drying a slurry containing dispersed carboxymethyloxysuccinate salt and detergent compound, to which slurry an alkali metal silicate is added after the addition of the carboxymethyloxysuccinate salt, with the slurry water content being maintained at not less than 40% of the final slurry formulation and a slurry temperature of not less than 76° C. This decreases the formation of insoluble lumps in the slurry and gives improved slurry viscosity control.

15 Claims, No Drawings

PRODUCTION OF DETERGENT COMPOSITIONS

The invention relates to the production of detergent compositions, and in particular to the production of detergent compositions which contain salts of carboxymethyloxysuccinic acid.

These compounds were recently disclosed as detergency builder salts to enhance the cleaning of detergent compositions, and to replace conventional phosphate detergency builders, as discussed fully in UK Patent No. 1,327,115. As explained in the aforementioned patent, the carboxymethyloxysuccinates are biodegradable and non-eutrophying compounds which are excellent substitutes for the established phosphate detergency builders which are alleged to be a factor in the eutrophication of lakes.

However, some problems have arisen in the production by normal slurry-making and spray-drying techniques of detergent powders incorporating the carboxymethyloxysuccinate detergency builders. More specifically, it was often found that insoluble lumps were formed in the slurry and also that the slurry sometimes gelled or became very viscous, both of which conditions made the slurries difficult to pump and spray dry in normal equipment. It has been presumed that the formation of lumps and the increase in viscosity or gelation are due to interaction between the carboxymethyloxysuccinates and some other unidentified ingredient(s) in the detergent compositions, possibly the alkali metal silicate commonly used. Of course, it is still possible to make particulate detergent compositions by normal dry-mixing techniques, but these generally give less satisfactory powders than spray-dried products which tend to be less dense and more homogeneous.

We have now found that good detergent powders containing the carboxymethyloxysuccinate salts as detergency builders can be prepared by slurry-making and spray-drying techniques, provided certain specific conditions are followed in the slurry making stage. These conditions are that the carboxymethyloxysuccinate salt should be dispersed in the aqueous slurry before the addition of alkali metal silicate, that the water content of the slurry should be not less than about 40%, preferably at least about 45%, especially about 50%, by weight of the final slurry formulation, and that the temperature of the slurry should be maintained at not less than 76° C, preferably at least about 80° C, subsequent to the addition of the carboxymethyloxysuccinate salt to the slurry. Adoption of these conditions with other usual slurry-making practices, gives satisfactory slurry properties and enables the subsequent spray drying of perfectly satisfactory detergent powders. It may be noted that a slurry water content of about 40% is generally sufficient for satisfactory slurry viscosity but is sometimes insufficient for optimum inhibition of lump or gel formation depending on the formulation of the product to be made. But for economic reasons the water content should be kept as low as possible, provided that the slurries have adequate properties.

The carboxymethyloxysuccinate detergency builder salts should be used in the form of an alkali metal, for example sodium, potassium or lithium, ammonium or substituted ammonium salts. Suitable substituted ammonium salts are the $C_1$ to $C_4$ mono- , di- and tri-alkyl ammonium, $C_1$ to $C_4$ mono-, di- and tri-alkanol ammonium salts and morpholinium salts, which must of course be water soluble or dispersible for detergents use. The preferred salt is trisodium carboxymethyloxysuccinate. It should be mentioned that the slurry may be formed with the addition of carboxymethyloxysuccinic acid, but in this case the acid should be neutralized in the slurry, for example with sodium hydroxide, beore addition of the silicate and subsequent spray drying.

Any of the conventional anionic, nonionic, zwitterionic or amphoteric detergent compounds can be used in the production of the detergent compositions according to the invention. But for reasons of economy and general performance, anionic and nonionic compounds are generally preferred. Nonionic detergent compounds are of particular benefit in the compositions of the invention, as they are relatively insensitive to the presence of calcium ions from hard water. They can therefore be used more efficiently with the carboxymethyloxysuccinate detergency builders, which are relatively weak sequestrants, as well as with detergency builder mixtures of the carboxymethyloxysuccinate with other builders, such as sodium tripolyphosphate. However, it may be noted that the slurry processing problems described above appear to be more acute when nonionic detergent compounds are used at significant levels, either as the sole detergent compound or in mixtures with anionic compounds as is more usual, but these problems can nevertheless be mitigated by using the process of the present invention.

Suitable nonionic detergent compounds include in particular the well-known ethoxylated alkyl phenols having 6 to 12 carbon atoms in the alkyl radical, which may be straight or branched, and having 6 to 25 molar proportions of ethylene oxide (EO), and ethoxylates of alkanols having 8 to 18 carbon atoms per molecule and 5 to 30 molar proportions of ethylene oxide, wherein the ethylene oxide content is generally at least about 52% by weight. Other suitable nonionic compounds are the Pluronics (trade mark of Wyandotte Corporation) formed by condensing propylene oxide with propylene glycol to a molecular weight of about 600 to 2,500 to form a base, followed by condensing ethylene oxide to this base to the extent of about 20% to about 90% by weight, total molecular basis.

Among suitable anionic detergent compounds that may be mentioned in particular are the alkylaryl sulphonates, more specifically the well known alkyl benzene sulphonates, wherein the alkyl group preferably has a straight chain of about 11 to about 15 carbon atoms and mixtures thereof, and the sulphonated phenyl group is randomly positioned along the alkyl chain. Alkyl sulphate salts may also be used, particularly sodium alkyl sulphates wherein the alkyl group is straight or branched substantially saturated, and has an average of about 12 to about 18 carbon atoms, or the corresponding alkyl ether sulphates containing about 1 to about 10 ethylene oxide units per molecule. Further useful anionic detergent compounds include alkane sulphonates having about 8 to about 18 carbon atoms, preferably about 10 to about 14 carbon atoms, disodium salts of alpha-sulphonated fatty acids or the methyl and ethyl esters thereof, or alkali metal acyl isethionates having about 12 to about 18 carbon atoms in the acyl group.

Zwitterionic or amphoteric detergent compounds may also be used, for example hydroxyalkylmethyltaurine, beta(hexadecyldiethylammonio)-propionate or 3-(tetradecyldimethylammonio)-ethane-1-sulphonate.

However any such zwitterionic or amphoteric detergent compounds will normally be used in conjunction with larger amounts of anionic or nonionic detergent compounds. Mixtures of anionic and nonionic detergent compounds are of particular benefit in low-sudsing detergent compositions, especially those intended for use in lather-intolerant automatic washing machines.

Other useful detergent compounds are described in the literature, for example in Schwartz and Perry "Surface Active Agents" and in Schwartz, Perry and Berch "Surface Active Agents and Detergents", published by Interscience in 1948 and 1958, respectively.

Another essential ingredient in the compositions produced according to the invention is an alkali metal silicate, preferably sodium alkaline silicate ($Na_2O:SiO_2 = 1:2$), the amount of which is preferably from about 3% to about 12% by weight, more especially from about 5% to about 8% by weight of the resultant composition. Sodium metasilicate ($Na_2O:SiO_2 = 1:1$) could possibly be used, but as this is more strongly basic than sodium alkaline silicate the amount of any sodium metasilicate used should be less than that of the alkaline silicate, in order to give the desired pH in the resultant product, i.e. usually about pH 9 to pH 11. Sodium neutral silicate and orthosilicates are preferably not used, except in admixture with alkaline or metasilicate, as the former is insufficiently basic and the latter is too strongly basic to give the desired pH in the end product at the silicate levels which are required. Moreover, the use of silicates with ratios of $Na_2O:SiO_2$ of over about 1:2.5, eg sodium neutral silicate which has a ratio of $Na_2O:SiO_2$ of 1:3.4, appears to be more prone to the formation of lumps or gel in the slurry.

It may be noted that a little silicate, up to about one quarter of the total silicate in the end product, may usually be tolerated in the slurry before the carboxymethyloxysuccinate salt is added, but this procedure is not recommended as it risks slurry problems under adverse circumstances.

The composition made in accordance with the invention may include other detergency builders than the carboxymethyloxysuccinate salts, for example sodium carbonate, the condensed phosphates, orthophosphates, starch or cellulose derived polycarboxylates, synthetic polyelectrolytes, and other ether carboxylates such as tetrasodium oxydisuccinate or disodium oxydiacetate. It is contemplated according to the invention that the carboxymethyloxysuccinate salts will be the principal detergency builders present, but the presence of these essential salts in low amounts (eg about 10%) can still contribute to deleterious slurry properties which are alleviated in the process of the present invention. It is therefore possible to use minor amounts of the carboxymethyloxysuccinate builder salts in conjunction with other detergency builders as mentioned above. The ratio of the carboxymethyloxysuccinate salts to such other builders should be from about 10:1 to about 1:5, preferably about 5:1 to about 1:5, especially about 2:1 to about 1:2 parts by weight.

The use of sodium tripolyphosphate and carboxymethyloxysuccinate salts as mixed detergency builders is a preferred aspect of the present invention, more especially in countries where legislation limits the maximum level of phosphorus in detergent compositions, for example to levels equivalent to a sodium tripolyphosphate content of not more than about 20%. In such cases the combined use of these modest levels of sodium tripolyphosphate with carboxymethyloxysuccinate salts can give viable detergent compositions, especially if other steps are taken to mitigate the effects of the decreased tripolyphosphate content compared with conventional practice, for example by the selection of more efficient detergent compounds, such as nonionic detergent compounds, which are less sensitive to the presence of calcium ions from hard water.

Other conventional additives may be included in the compositions made by the process of the invention, particularly soil-suspending agents, hydrotropes, corrosion inhibitors, dyes, perfumes, optical brighteners, fillers, suds boosters, suds depressants, anticaking agents, alkaline compounds, buffers, enzymes and the like. Further particularly preferred additives are oxygen-releasing bleaching agents which are especially effective when used with the carboxymethyloxysuccinate detergency builders.

If a nonionic detergent compound is used, as is preferred, it is also advantageous to include in the detergent compositions a slurry processing aid, such as copolyethylene-vinyl-methylether, which helps to disperse the nonionic detergent compound in the slurry and thereby inhibit slurry separation. In this event it is advantageous to disperse the slurry processing aid in the nonionic detergent compound itself prior to their simultaneous addition to the slurry, which may be before or after the carboxymethyloxysuccinate and preferably before the alkali metal silicate.

The amount of essential carboxymethyloxysuccinate detergency builder should be from about 10% to about 60% by weight of the detergent composition, preferably from about 15% to about 40% by weight. Normally of course lower amounts within this range will be used when other detergency builders are present in the compositions. The amount of detergent compound or compounds used should be from about 5% to about 40% by weight, preferably from about 10% to about 30% by weight of the resultant composition. When a nonionic detergent compound is used as the sole or predominant detergent compound, the amount of detergent compounds in the compositions is generally within the range of about 10% to about 20% by weight.

The slurry processing should be undertaken in stirred vessels, which may be of the usual type for slurry making. But preferably, excessively high-shear mixing, e.g., in colloid mills, should be avoided. Normally, mixing should be continued throughout slurry making and afterwards until spray drying is completed. Conventional pumping and spray-drying equipment may be used subsequent to the slurry making step, with normal conditions being used in the spray drying process, for example temperatures of about 150° C to 400° C for the drying gas inlet temperatures.

The ingredients may be added to the mixing vessels in the usual manner, i.e. either in liquid, aqueous solution, or solid form, subject to the requirement that the carboxymethyloxysuccinate salt is added prior to the sodium silicate and that the water content and temperature requirements are followed. Generally speaking, the order of addition of other ingredients does not matter, but it is generally advantageous to have some water added at an early stage to facilitate mixing, with the other ingredients preferably being added before the carboxymethyloxysuccinate salt and the alkali metal silicate. It is, however, preferably to add the detergent compound or compounds to the slurry before the carboxymethyloxysuccinate salt, particularly if the detergent compound is an anionic compound which is formed by neutralisation in the slurry itself, when a high water content in the slurry facilitates mixing and the dissipation of heat.

The invention is illustrated by the following Examples in which parts and percentages are by weight except where otherwise indicated.

EXAMPLE 1

A detergent powder was made by spray drying a detergent slurry which had a moisture content of 50% and was prepared at a temperature of 80° C. The order of addition of the ingredients to the slurry in a crutcher mixer is shown in the following formulation of the end product (dry basis).

| Ingredients | Parts |
|---|---|
| Water (evaporated during spray drying) | — |
| Sodium alkyl benzene sulphonate | 3 |
| Sodium stearate (formed in the slurry from sodium hydroxide and stearic acid) | 3 |
| Sodium sulphate | 15.3 |
| Sodium carboxymethylcellulose | 1 |
| Sodium tripolyphosphate | 10 |
| Sodium carboxymethyloxysuccinate | 25 |
| Tallow alcohol - 18EO | 9 |
| Copolyethylene-vinylmethylether (1:1)[1] | 1 |
| Sodium alkaline silicate | 5 |
| Magnesium silicate | 1 |

[1]Obtained as Gantrez AN119 from General Aniline and Film Corporation, and dispersed in the nonionic compound before addition to the slurry.

The slurry did not form lumps or increase unduly in viscosity during its preparation and was readily pumpable and sprayable with normal equipment. The resultant powder had perfectly satisfactory powder properties, and was suitable for commercial use after the addition thereto of additional ingredients which are not usually included in the slurry, particularly bleaching agents and proteolytic enzymes.

When the above procedure was followed using water contents of 40% and 45%, slurry viscosity was increased but still adequate for pumping.

When the sodium alkaline silicate was changed to sodium neutral silicate (same dry material content as the alkaline silicate), the slurries were very markedly worse with lump formation at 40% water content, though at 50% water content the slurry was processable with difficulty.

EXAMPLE 2

The procedure of Example 1 was repeated except that the carboxymethyloxysuccinate salt was added to the initial water before the sodium alkyl benzene sulphonate. In this case it was found necessary to use the 50% water content in the slurry for adequate viscosity, as with 40% and 45% water content the viscosity was too high.

EXAMPLE 3

The procedure of Example 1 was repeated except that 1.25 parts of the sodium alkaline silicate were added after the sodium alkyl benzene sulphonate, leaving 3.75 parts to be added after the carboxymethyloxysuccinate salt. Again the slurry properties were adequate, though noticeably worse than for the slurry of Example 1. When all the alkaline silicate was added initially the slurry became lumpy.

EXAMPLES 4 and 5

The procedure of Example 1 was repeated except that the amounts of the detergency builders sodium carboxymethyloxysuccinate (CMOS) and sodium tripolyphosphate were changed as follows:

| | Example 4 | Example 5 |
|---|---|---|
| Sodium carboxymethyloxysuccinate | 15 | 35 |
| Sodium tripolyphosphate | 20 | — |

Again slurry properties and resultant powder characteristics were satisfactory.

EXAMPLES 6 to 9

The procedure of Example 1 was again repeated except that the amounts of sodium carboxymethyloxysuccinate and sodium tripolyphosphate were as in Example 4 and the amounts of the detergent active compounds were changed as follows:

| | Example | | | |
|---|---|---|---|---|
| | 6 | 7 | 8 | 9 |
| Sodium alkyl benzene sulphonate | 3 | — | 13 | 7.5 |
| Tallow alcohol - 18EO | 12 | 12 | — | 2.5 |
| Sodium stearate | — | 3 | 2 | 4.5 |

In all cases the slurry properties were good, but the resultant detergent powders had creepy flow characteristics until after 24 hours weathering when they became acceptable.

EXAMPLES 10 and 11

Two detergent slurries were prepared in a crutcher and then spray dried to give products of the following formulations:

| Ingredient | % Ex. 10 | % Ex. 11 |
|---|---|---|
| Water | 3.0 | 3.0 |
| Sodium tridecyl benzene sulphonate | 25.0 | 28.0 |
| Sodium $C_{14}$–$C_{18}$ soap[1] | 1.0 | 1.0 |
| Sodium carboxymethylcellulose | 0.29 | 0.29 |
| Flourescent dye | 0.03 | 0.03 |
| Sodium carboxymethyloxysuccinate | 25.0 | 35.0 |
| Sodium sulphate | 29.86 | 12.23 |
| Sodium silicate ($Na_2O:SiO_2$, 1:2.4) | 6.0 | 6.0 |
| Miscellaneous[2] | 8.82 | 13.95 |
| Dicalite (microporous silicate)[3] | 1.00 | 0.5 |

[1]Formed in situ by addition of stearic acid and palmitic acids.
[2]Includes inert salt contents of some ingredients supplied in impure form and perfume.
[3]Added to the detergent powder after spray drying.

The ingredients were added to the crutcher in the order shown above, with the exception of the miscellaneous ingredients and the Dicalite, which is added to improve powder flow and storage properties. The water content of the slurry was a nominal 40%, and the slurry was heated to 82° C prior to the silicate addition and then finally heated to 88° C prior to spray drying.

Using the above conditions it was found possible to make a satisfactory detergent powder, though a slight tendency to gel and increased slurry viscosity were noted on the addition of the silicate. When the silicate level was increased to 15.0% and changed to $Na_2O$:-$SiO_2$, 1:3.2 type silicate, there was extensive lump formation, and the slurry could not be pumped satisfactorily.

What is claimed is:

1. A process for making a spray dried powdered detergent composition containing a carboxymethyloxysuccinate salt detergency builder, at least one detergent compound and an alkali metal silicate, comprising the steps of, a. forming an aqueous detergent slurry containing dispersed carboxymethyloxysuccinate and said detergent compound said detergent compound being selected from the group consisting of anionic, nonionic, zwitterionic and amphoteric detergents;

b. adding alkali metal silicate to the aqueous slurry after the addition thereto of the carboxymethyloxysuccinate salt, wherein the alkali metal oxide to silicon dioxide ratio of said silicate is about 1:1 to about 1:2.5;

c. maintaining the water content of the slurry at not less than about 40 percent by weight of the final slurry formulation;

d. maintaining the slurry temperature at not less than 76° C subsequent to the addition of the carboxymethyloxysuccinate salt thereto; and e.spray drying the detergent slurry, the amount of the carboxymethyloxysuccinate salt being from about 10 percent to about 60 percent, the amount of the detergent compound being about 5 percent to about 40 percent and the amount of the alkali metal silicate being about 3 percent to about 12 percent by weight of the final detergent composition.

2. A process according to claim 1, wherein the detergent compound is added to the slurry before the carboxymethyloxysuccinate salt.

3. A process according to claim 1, wherein the slurry is maintained at a temperature of at least about 80° C subsequent to the addition of the carboxymethyloxysuccinate salt.

4. A process according to claim 1, wherein the water content is at least about 45% of the final slurry formulation.

5. A process according to claim 4, wherein the water content is at least about 50% of the final slurry formation.

6. A process according to claim 1, wherein the carboxymethyloxysuccinate salt is trisodium carboxymethyloxysuccinate.

7. A process according to claim 1, wherein the detergent compound is a nonionic compound.

8. A process according to claim 1, wherein the alkali metal silicate is sodium alkaline silicate.

9. A process according to claim 1, wherein the alkali metal silicate is sodium metasilicate.

10. A process according to claim 1, wherein the amount of the carboxymethyloxysuccinate salt is about 15% to about 40% by weight of the final composition.

11. A process according to claim 1, wherein the amount of the detergent compound is about 10% to about 30% by weight of the final composition.

12. A process according to claim 1, wherein the amount of the silicate is about 5% to about 8% by weight of the final composition.

13. A process according to claim 1, wherein another detergency builder is added to the slurry in a ratio of about 5:1 to 1:5 parts by weight of the other builder to the carboxymethyloxysuccinate salt.

14. A process according to claim 13, wherein the other detergency builder is sodium tripolyphosphate.

15. A detergent composition when made by a process according to claim 1.

* * * * *